US006843223B2

(12) United States Patent
Yanagii

(10) Patent No.: US 6,843,223 B2
(45) Date of Patent: Jan. 18, 2005

(54) TANDEM VALVE TYPE THROTTLE BODY

(75) Inventor: Yoichi Yanagii, Kawasaki (JP)

(73) Assignee: Keihin Corporation, Tokyo (JP)

( * ) Notice: Subject to any disclaimer, the term of this patent is extended or adjusted under 35 U.S.C. 154(b) by 82 days.

(21) Appl. No.: 10/238,430

(22) Filed: Sep. 9, 2002

(65) Prior Publication Data

US 2003/0047167 A1 Mar. 13, 2003

(30) Foreign Application Priority Data

Sep. 11, 2001 (JP) ..... 2001-275115

(51) Int. Cl.[7] ..... F02D 9/02

(52) U.S. Cl. ..... 123/336; 123/399; 123/442

(58) Field of Search ..... 123/336, 361, 123/399, 442; 180/179, 197; 251/305

(56) References Cited

FOREIGN PATENT DOCUMENTS

JP 5-113138 * 5/1993 ..... 123/336

* cited by examiner

*Primary Examiner*—Tony M. Argenbright
(74) *Attorney, Agent, or Firm*—Zito tlp; Joseph J. Zito; Kendal M. Sheets

(57) ABSTRACT

To improve freedom of mounting to a motor cycle, a tandem valve type throttle body is provided with a throttle valve (4) in the downstream side of an intake passage (2) and a sub throttle valve (9) in the upstream side thereof, a sub throttle valve shaft (8) is rotated by a motor (M), a sub throttle valve lever (10) and a throttle valve lever (5) are connected by a transmission member, the shaft (8) and a sensor rotor (TA) of an opening degree sensor (T) are energized in the opening direction of the shaft (9) by a rotor spring (TC), a link lever spring (14) pressing the transmission member (12) in one direction is energized in the closing direction of the valve (9), and torque is set so as to cancel spring forces applied to the shaft (8) by both the springs (TC), (14).

2 Claims, 4 Drawing Sheets

TANDEM VALVE TYPE THROTTLE BODY

BACKGROUND OF THE INVENTION

1. Field of the Invention

The present invention relates to a throttle body which controls an amount of air moving toward an engine, and more particularly to a tandem valve type throttle body which is provided with a throttle valve controlled so as to be opened and closed by an accelerator within an intake passage provided in the throttle body, and a sub throttle valve arranged in the intake passage in an upstream side of the throttle valve and operated so as to be opened and closed by an electromagnetic actuator or the like.

2. Description of Prior Art

In accordance with a conventional tandem valve type throttle body, the throttle valve is operated so as to be opened and closed by the accelerator, and the sub throttle valve is operated so as to be closed by the electromagnetic actuator or the like. For example, at a time of traction control or the like, the sub throttle valve is forcibly closed, whereby a torque of the engine is reduced at a time when a slip is generated. Further, in the tandem valve type throttle body, the sub throttle valve is left open at a high opening degree by the electromagnetic actuator, and the throttle valve is forcibly left open toward a first idle opening degree from an idle opening degree in synchronization with the opening motion of the sub throttle valve without relation to an accelerator operation, thereby increasing an air amount moving toward the engine and improving a low temperature starting characteristic of the engine.

In the conventional tandem valve type throttle body mentioned above, the sub throttle valve attached to a sub throttle valve shaft and the throttle valve attached to a throttle valve shaft are structured such that a sub throttle valve lever fixed to and arranged at one end of the sub throttle valve shaft and a throttle valve lever fixed to and arranged at one end of the throttle valve shaft are connected to each other by a transmission member constituted by a link arm, a link lever and the like. Further, a motor corresponding to the electromagnetic actuator driven by an output signal from an ECU is connected to another end of the sub throttle valve shaft via a gear. On the other hand, in the case of employing the transmission member mentioned above, the link arm and the link lever are rotatably connected to respective supporting shafts, whereby a rotation of the sub throttle valve lever is transmitted to the throttle valve lever. Further, a spring member for absorbing a play in the connection portion to one side is engaged with and arranged in the transmission member. The absorption of the play is effective in view of reducing a hysteresis and an abrasion at a time of forward and backward rotating of the transmission member. Further, in the case of arranging the spring member in the transmission member, a spring force of the spring member forms a resistance against driving of the motor, so that it is hard to employ a compact motor in which a generated torque of the motor is small, and in particular, a problem is generated in a structure such as a motor cycle in which a receiving space is limited.

SUMMARY OF THE INVENTION

The present invention is made by taking the problem mentioned above into consideration, and an object of the present invention is to provide a compact tandem valve type throttle body in which a transmission member for mechanically connecting a sub throttle valve lever to a throttle valve lever is pressed to one side by a spring member so as to absorb a play in a connection portion, wherein a motor applying a drive force to a sub throttle valve shaft is made compact and a freedom of mounting to a motor cycle is increased.

In order to achieve the object mentioned above, in accordance with a first aspect of the present invention, there is provided a tandem valve type throttle body comprising:

a throttle valve which is attached to a throttle valve shaft, and opens and closes an intake passage interlocking with an accelerator operation;

a throttle valve lever which is attached to the throttle valve shaft, and is energized in a closing direction of the throttle valve by a throttle valve return spring;

a sub throttle valve which is attached to a sub throttle valve shaft, and opens and closes the intake passage in an upstream side from the throttle valve;

a motor which operates so as to open and close the sub throttle valve on the basis of a signal output from an ECU in response to an output signal from an opening degree sensor for detecting a rotation angle of the sub throttle valve shaft; and a transmission member constituted by a link arm, a link lever, and the like, which opens throttle valve toward a first idle opening degree at a high opening degree of the sub throttle valve, wherein a rotor spring which presses and engages the sub throttle valve shaft and a sensor rotor of the opening degree sensor in a rotational direction is energized in an opening direction of the sub throttle valve, and a link lever spring which presses the transmission member to one direction is energized in a closing direction of the sub throttle valve, whereby a torque is set in such a manner as to cancel spring forces applied to the sub throttle valve shaft with each other.

Further, in accordance with a second aspect of the present invention, there is provided a tandem valve type throttle body as recited in the first aspect mentioned above, wherein the combined torque between the rotor spring and the link lever spring applied to the sub throttle valve shaft is energized in the closing direction of the sub throttle valve at a middle opening degree of the sub throttle valve or more.

In accordance with the first aspect of the present invention, since the spring force of the sensor spring and the spring force of the link lever spring are applied to the sub throttle valve shaft, and the torque is set in such a manner as to cancel the spring forces of both of the springs applied to the sub throttle valve shaft with each other, it is possible to make the, torque of the motor driving the sub throttle valve shaft small, whereby it is possible to make the motor compact.

Further, in accordance with the second aspect of the present invention, since the sub throttle valve is energized in the closing direction at the middle opening degree of the sub throttle valve or more, the sub throttle valve is not unnecessarily left open, for example, at a time when an electric current application to the motor is shut off.

DESCRIPTION OF THE PREFERRED EMBODIMENT

A description will be given below of an embodiment of a tandem valve type throttle body in accordance with the present invention with reference to FIG. 1.

Figure 1:
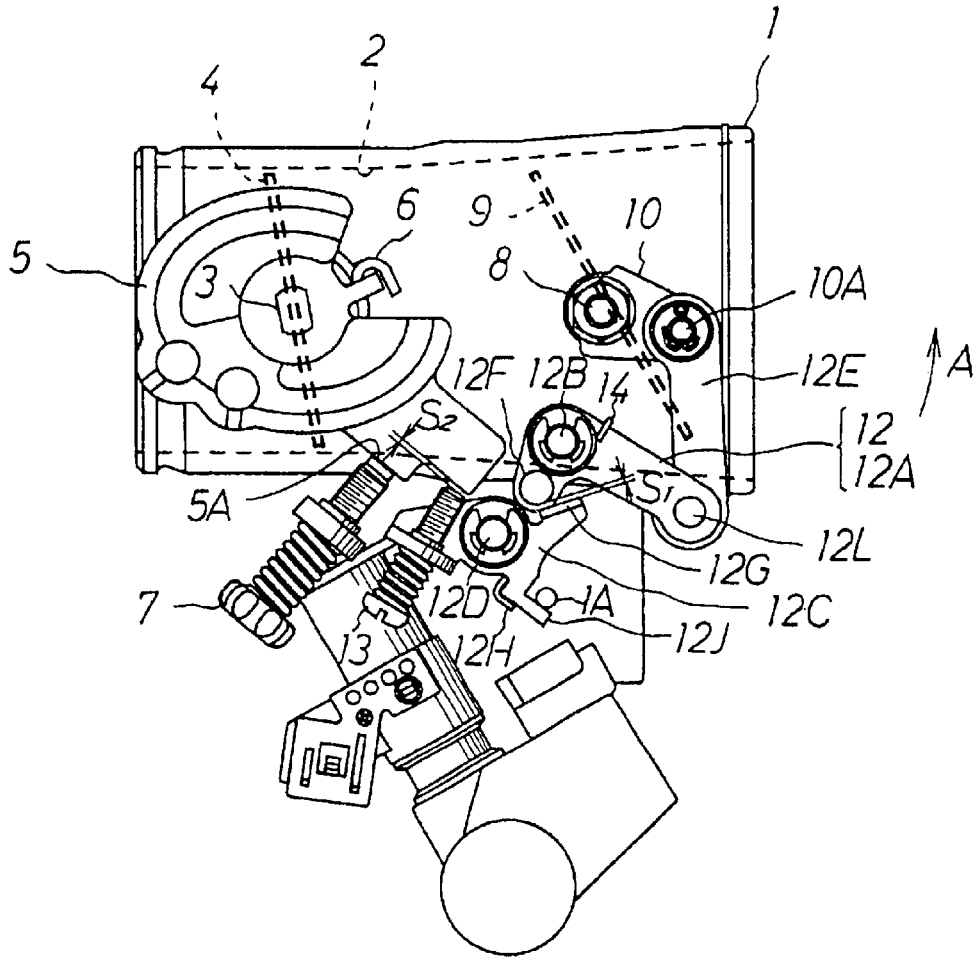
FIG. 1 is a side view which shows one embodiment of a tandem valve type throttle body in accordance with the present invention.

FIG. 1 is a side view of a tandem valve type throttle body, and shows a state in which a throttle valve is at an idle opening degree and a sub throttle valve is at a low opening degree. Reference numeral 1 denotes a throttle body in which an intake passage 2 is provided in an inner portion so as to pass therethrough. A downstream side of the throttle body 1 is connected to an engine (not shown) by an intake pipe. Reference numeral 3 denotes a throttle valve shaft which is rotatably supported to the throttle body 1 across the intake passage 2. A throttle valve 4 opening and closing the intake passage is attached to the throttle valve shaft 3. Further, a throttle valve lever 5 is attached to one end of the throttle valve shaft 3, and one end of a throttle valve return spring 6 which applies a rotation force in a clockwise direction in the drawing (a throttle valve closing direction) is engaged with the throttle valve lever 5. The throttle valve lever 5 is operated by an accelerator (not shown), and the throttle valve 4 opens the intake passage 2 in accordance with the rotation of the throttle valve lever 5 in a counterclockwise direction, and closes the intake passage 2 in accordance with the rotation in the clockwise direction. In this case, reference numeral 7 denotes a stop screw which adjusts an idling opening degree of the throttle valve 4. At a time of the idle opening degree mentioned above, a leading end of the stop screw 7 is engaged with an end portion of an arm portion 5A in the throttle valve lever 5.

Figure 2:
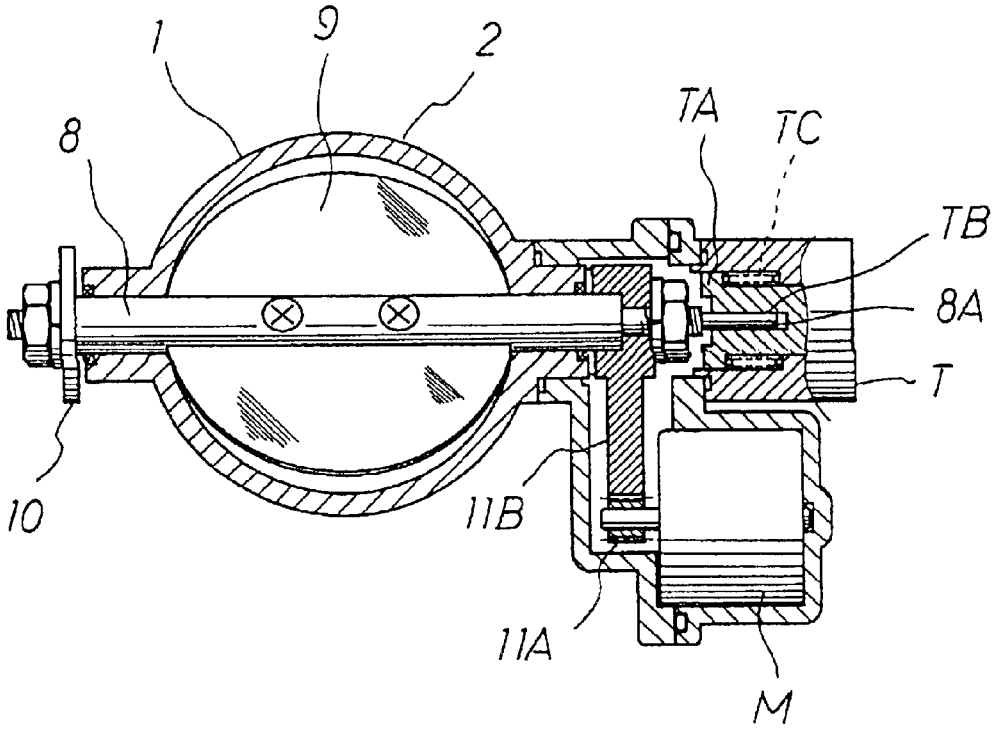
FIG. 2 is a vertical cross sectional view of a main portion along a line X—X in FIG. 1.

Reference numeral 8 denotes a sub throttle valve shaft which is supported to the throttle body 1 across the intake passage 2 in an upstream side (a right side in the drawing) from the throttle valve 4. A sub throttle valve 9 which opens and closes the intake passage 2 is arranged in the sub throttle valve shaft 8, and a sub throttle valve lever 10 is integrally attached to one end of the sub throttle valve shaft 8. Further, an opening degree sensor T and a motor M are arranged at another end of the sub throttle valve shaft 8. A description will be given with reference to FIG. 2. The opening degree sensor T is structured such as to output an electric voltage which is in proportion to the opening degree of the sub throttle valve shaft 8 toward an ECU which is not disclosed. A flat face groove TB of a sensor rotor TA is engaged with a flat face portion 8A at another end of the sub throttle valve shaft 8, whereby the sensor rotor TA and the sub throttle valve shaft 8 synchronously rotate. Further, one end of a rotor spring TC is engaged with the sensor rotor TA, whereby a force to the sub throttle valve 9 in an opening direction (the counterclockwise direction in FIG. 1) is energized to the sub throttle valve shaft 8 via the sensor rotor TA. The rotational direction is denoted by reference symbol A in FIG. 1. A motor M is structured such as to be driven on the basis of an output signal from the ECU (not shown), and an output shaft of the motor M and the sub throttle valve shaft 8 are connected by gears 11A and 11B.

Then, the sub throttle valve lever 10 and the throttle valve lever 5 are connected by a transmission member 12. Reference symbol 12A denotes a first link lever which is rotatably supported to a first shaft 12B, and reference symbol 12C denotes a second link lever which is rotatably supported to a second shaft 12D. Then, the sub throttle valve lever 10 and the first link lever 12A are connected by a link arm 12E. The sub throttle valve lever 10 and the link arm 12E are axially connected by a third shaft 10A, and the first link lever 12A and the link arm 12E are axially connected by a fourth shaft 12L. Further, a roller 12F provided in the first link lever 12A is arranged so as to face to a tongue piece portion 12G provided in the second link lever 12C, this roller 12F and the tongue piece portion 12G are arranged with a gap S1 without being brought into contact with each other at a low opening degree time of the sub throttle valve 9, and the roller 12F presses the tongue piece portion 12G at least at a high opening degree time of the sub throttle valve 9 so as to rotate the second link lever 12C in a clockwise direction in the drawing. A state in FIG. 1 corresponds to a state in which the sub throttle valve 9 is at the low opening degree, the gap S1 is formed between the roller 12F and the tongue piece portion 12G at this time, an engagement portion 12J of the second link lever 12C is brought into contact with a restriction portion 1A provided in the throttle body 1 in a standing manner on the basis of a spring force of a first idle spring 12H, a leading end of the first idle screw 13 which is engaged with the second link lever 12C in this state is not brought into contact with the arm portion 5A of the throttle valve lever 5, and then a gap S2 is formed. In this case, since it is sufficient that the first idle spring 12H has a spring force for simply bringing an engagement portion 12J of the second link lever 12C into contact with the restriction portion 1A, an extremely weak force may be employed, so that an application of the rotational force to the sub throttle valve shaft 8 is negligible. Further, a play in the connection portion among the sub throttle valve lever 10, the link arm 12E and the first link lever 12A is absorbed by a link lever spring 14, and a spring force of the link lever spring 14 is applied in the closing direction of the sub throttle valve 9.

Further, when the motor M is rotated on the basis of the output signal from the ECU (not shown) and the gears 11A and 11B are rotated, the sub throttle valve shaft 8 is synchronously rotated with the gear 11A, and the sub throttle valve 9 controls the opening of the intake passage 2 in an upstream side from the throttle valve 4, whereby it is possible to execute, for example, a traction control. Then, a rotational angle of the sub throttle valve shaft 8 is transmitted to the sensor rotor TA from the flat face portion 8A of the sub throttle valve shaft 8, and the signal corresponding to the rotational angle of the sensor rotor TA is output toward the ECU. On the other hand, the rotation of the sub throttle valve shaft 8 is transmitted to the first link lever 12A from the sub throttle valve lever 10 via the link arm 12E, and at this time, the sub throttle valve lever 10 and the first link lever 12A are rotated in the same direction. Further, since at this time, the rotational force of the sub throttle valve 9 in the opening direction is applied to the sub throttle valve lever 10 by the rotor spring TC, and on the contrary, the rotational force of the sub throttle valve 9 in the closing direction is applied to the first link lever 12A by the link lever spring 14, the play in the connection portion among the link arm 12E, the third shaft 10A and the fourth shaft 12L is absorbed, whereby an abrasion in the connection portion at a time of operating of the engine can be prevented.

Figure 4:
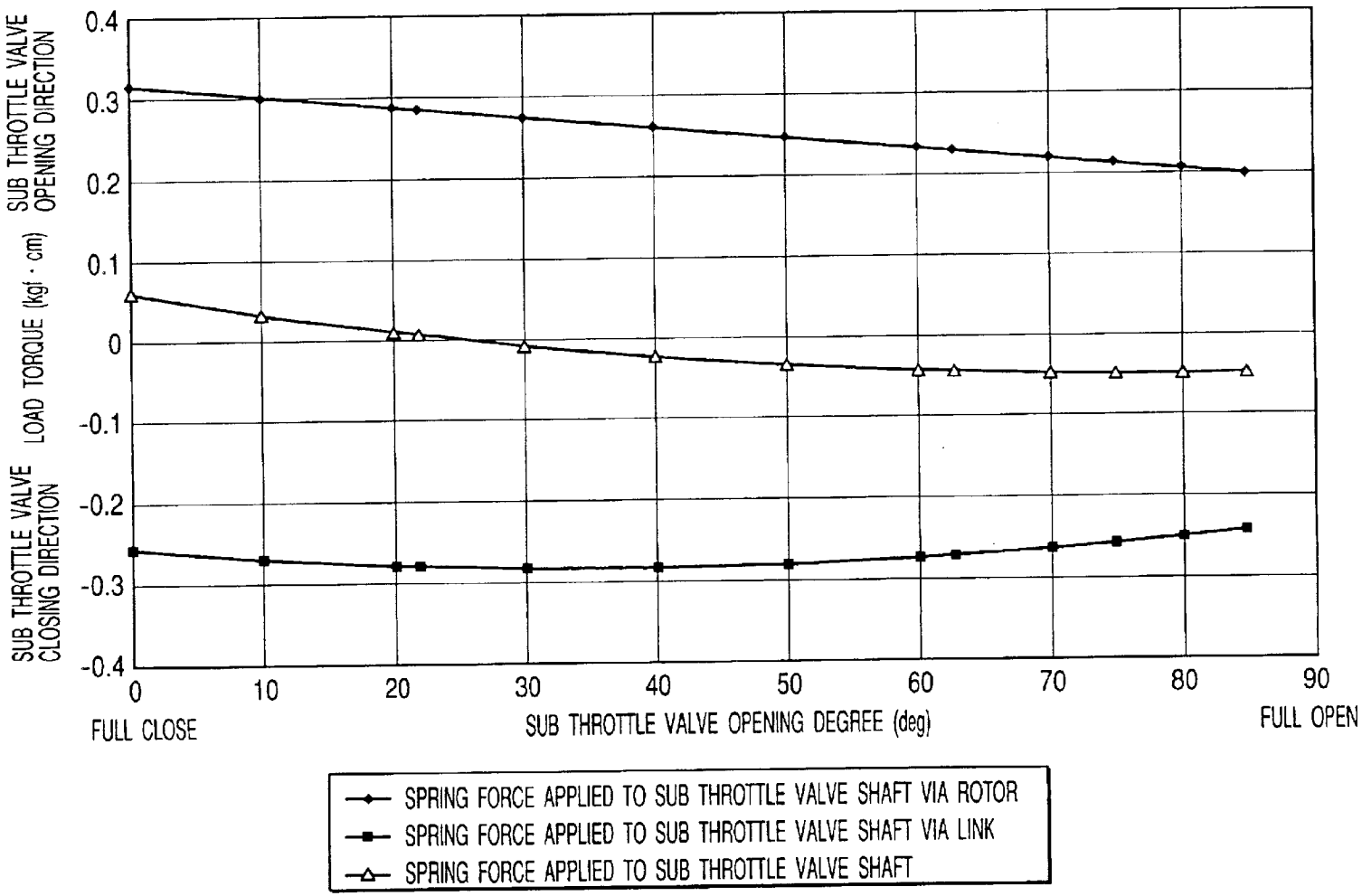
FIG. 4 is a line graph that shows relations between a spring force applied to the sub throttle valve shaft via the rotor spring (a line -●-), a spring force applied to the sub throttle valve shaft via the link lever spring (a line -■-), and a spring force combinedly applied to sub throttle valve shaft (a line -▲-) all of which are indicated as load torques (kgf-cm) in the direction for opening or closing the sub throttle valve, and sub throttle valve opening degrees from full closing to full opening.

Further, at the operating time of the sub throttle valve 9 mentioned above, since the spring force of the rotor spring TC is applied to the sub throttle valve shaft 8 toward the opening direction of the sub throttle valve 9 (the spring force applied to the sub throttle valve shaft via the rotor spring TC is shown as a line -●- in FIG. 4), and the spring force of the link lever spring 14 is applied to the sub throttle valve shaft 8 toward the closing direction of the sub throttle valve 9 (the spring force applied to the sub throttle valve shaft via the link lever spring 14 is shown as a line -■- in FIG. 4), it is possible to lighten the spring force which is combinedly applied to the sub throttle valve shaft 8 by both of the springs TC and 14, whereby it is possible to employ a compact motor having a small torque. (In this case, the spring force which is combinedly applied to the sub throttle valve shaft 8 is disclosed as a line -▲- in FIG. 4.) Further, in the case that the compact motor can be employed, it is possible to achieve a low cost of the motor and it is possible to achieve a compact size of the throttle body, and in particular, it is possible to improve a mounting characteristic to a motor cycle in which a receiving space is limited.

Figure 3:
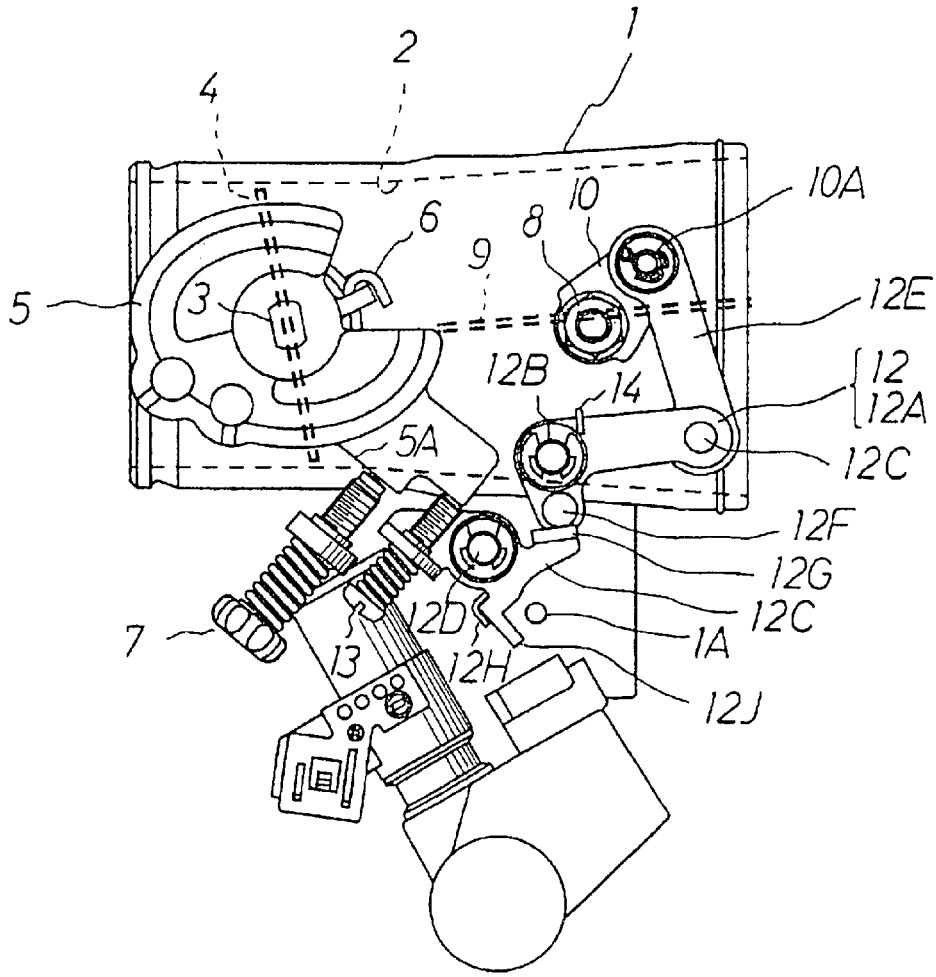
FIG. 3 is a side view which shows a first idle state at a full opening degree of a sub throttle valve in the tandem valve type throttle body.

Further, in accordance with the present embodiment, when the sub throttle valve 9 is left open at the high opening degree, the roller 12F provided in the first link lever 12A is brought into contact with the tongue piece portion 12G of the second link lever 12C so as to rotate the second link lever 12C in the clockwise direction. In accordance with this structure, the leading end of the first idle screw 13 is brought into contact with the arm portion 5A of the throttle valve lever 5 so as to slightly rotate the throttle valve lever 5 in the clockwise direction, whereby the throttle valve 4 opens the intake passage 2 toward the first idle opening degree from the idling opening degree. This state is shown in FIG. 3. Further, the opening motion of the sub throttle valve 9 to the high opening degree is executed under a state in which an atmospheric temperature of the engine is low. When the throttle valve 4 accordingly reaches the first idling opening degree which is open more than the idling opening degree, it is possible to increase an amount of starting air to the engine and in particular, it is possible to improve a low temperature starting characteristic of the engine.

Further, in the case that the torque (a load torque kgf.cm) which is combinedly applied by the rotor spring TC and the link lever spring 14 to the sub throttle valve shaft 8 is applied to the sub throttle valve 9 in the closing direction at the middle opening degree of the sub throttle valve 9 or more, the sub throttle valve 9 is not operated to the open side, for example, even under a state in which the electric current application to the motor M is shut off. The setting of the spring forces of both of the springs TC and 14 and one side of the combined torque are shown in FIG. 4, and in the present embodiment, in the state in which the opening degree of the sub throttle valve 9 is 20 degrees or more, the torque is energized in the closing direction of the sub throttle valve 9.

As mentioned above, in accordance with the tandem valve type throttle body of the present invention, since the rotor spring which presses and engages the sub throttle valve shaft and the sensor rotor of the opening degree sensor in the rotational direction is energized in the opening direction of the sub throttle valve, and the link lever spring which presses the transmission member to one direction is energized in the closing direction of the sub throttle valve, whereby the torque is set in such a manner as to cancel spring forces applied to the sub throttle valve shaft with each other, it is possible to make the motor rotating the sub throttle valve shaft compact, whereby it is possible to achieve a reduction of manufacturing cost of the tandem valve type throttle body and it is possible to improve a freedom of mounting to the motor cycle. Further, it is possible to reduce an abrasion in the connection portion between the sub throttle valve lever and the transmission member constituted by the link arm and the first link lever, and it is possible to provide the throttle body which is excellent in durability. Further, in the case that the combined torque between the rotor spring and the link lever spring applied to the sub throttle valve shaft is energized in the closing direction of the sub throttle valve at the middle opening degree of the sub throttle valve or more, the sub throttle valve is not operated to the open side even if the motion of the motor is in trouble or the like, so that it is possible to improve a reliability.

What is claimed is:

1. A tandem valve type throttle body comprising:

a throttle valve which is attached to a throttle valve shaft, and opens and closes an intake passage interlocking with an accelerator operation;

a throttle valve lever which is attached to the throttle valve shaft, and is energized in a closing direction of the throttle valve by a throttle valve return spring;

a sub throttle valve which is attached to a sub throttle valve shaft, and opens and closes the intake passage in an upstream side from the throttle valve;

a motor (M) which operates so as to open and close the sub throttle valve on the basis of a signal output from an ECU in response to an output signal from an opening degree sensor (T) for detecting a rotation angle of the sub throttle valve shaft; and a transmission member constituted by a link arm, a link lever and the like, which opens throttle valve toward a first idle opening degree at a high opening degree of the sub throttle valve, wherein a rotor spring (TC) which presses and engages the sub throttle valve shaft and a sensor rotor (TA) of the opening degree sensor (T) in a rotational direction is energized in an opening direction of the sub throttle valve, and a link lever spring which presses the transmission member to one direction is energized in a closing direction of the sub throttle valve, whereby a torque is set in such a manner as to cancel spring forces applied to the sub throttle valve shaft with each other.

2. A tandem valve type throttle body as claimed in claim 1, wherein the combined torque between the rotor spring (TC) and the link lever spring applied to said sub throttle valve shaft is energized in the closing direction of the sub throttle valve at a middle opening degree of the sub throttle valve or more.

* * * * *